US011306995B2

(12) United States Patent
Muska

(10) Patent No.: US 11,306,995 B2
(45) **Date of Patent: *Apr. 19, 2022**

(54) SHOTGUN CONFIGURATION

(71) Applicant: Smith & Wesson Inc., Springfield, MA (US)

(72) Inventor: Simon M. Muska, Enfield, CT (US)

(73) Assignee: Smith & Wesson Inc., Springfield, MA (US)

( * ) Notice: Subject to any disclaimer, the term of this patent is extended or adjusted under 35 U.S.C. 154(b) by 117 days.

This patent is subject to a terminal disclaimer.

(21) Appl. No.: 16/924,530

(22) Filed: Jul. 9, 2020

(65) Prior Publication Data

US 2021/0041208 A1 Feb. 11, 2021

Related U.S. Application Data

(60) Provisional application No. 62/883,160, filed on Aug. 6, 2019.

(51) Int. Cl.

| | |
|---|---|
| ***F41A 3/66*** | (2006.01) |
| ***F41C 7/02*** | (2006.01) |
| ***F41A 17/34*** | (2006.01) |
| ***F41A 9/72*** | (2006.01) |

(52) U.S. Cl.

CPC ..... *F41C 7/02* (2013.01); *F41A 3/66* (2013.01); *F41A 9/72* (2013.01); *F41A 17/34* (2013.01)

(58) Field of Classification Search

CPC .... F41A 3/66; F41A 9/72; F41C 23/00; F41C 23/20; F41C 23/14; F41C 7/02

See application file for complete search history.

(56) References Cited

U.S. PATENT DOCUMENTS

| | | | |
|---|---|---|---|
| 1,344,991 | A | 6/1920 | Cunningham |
| 1,386,247 | A | 8/1921 | Fordyce |
| 1,637,400 | A | 8/1927 | Von Kiraly et al. |
| 1,709,399 | A | 4/1929 | Herlach et al. |
| 1,801,072 | A | 4/1931 | Browning |
| 1,801,073 | A | 4/1931 | Browning |
| 1,803,352 | A | 5/1931 | Tansley |
| 1,818,984 | A | 8/1931 | Browning |
| 1,878,038 | A | 9/1932 | Frommer |
| 1,892,259 | A | 12/1932 | Frommer |
| 1,907,164 | A | 5/1933 | White |
| 1,911,494 | A | 5/1933 | Floyd |
| 2,016,646 | A | 10/1935 | Mancini |
| 2,047,789 | A | 7/1936 | Loomis |
| 2,196,852 | A | 4/1940 | Browning |

(Continued)

FOREIGN PATENT DOCUMENTS

| | | |
|---|---|---|
| CH | 175058 | 2/1935 |
| DE | 202004016026 | 1/2005 |

(Continued)

*Primary Examiner* — J. Woodrow Eldred

(74) *Attorney, Agent, or Firm* — John A. Chionchio, Esq.; Ballard Spahr LLP

(57) ABSTRACT

A shotgun is formed of sub-assemblies which include a lower receiver upon which a butt stock and an upper receiver are mounted. The lower receiver houses the fire control mechanism, the butt stock includes an ammunition elevator and a breech cover. Magazine tubes, ammunition cut-offs, a selector, a selector interrupter and the barrel are mounted on the upper receiver.

27 Claims, 7 Drawing Sheets

(56) References Cited

U.S. PATENT DOCUMENTS

| | | | |
|---|---|---|---|
| 2,391,756 | A | 12/1945 | Vesely |
| 2,562,037 | A | 7/1951 | Humeston |
| 2,637,247 | A | 5/1953 | Hester |
| 2,970,398 | A | 2/1961 | Crouch |
| 3,020,662 | A | 2/1962 | Merkel |
| 3,075,511 | A | 1/1963 | Ryan |
| 3,077,044 | A | 2/1963 | Reed |
| 3,101,703 | A | 8/1963 | Ryan |
| 3,233,546 | A | 2/1966 | Foote et al. |
| 3,399,481 | A | 9/1968 | Giorgini |
| 3,512,290 | A | 5/1970 | Violette, Jr. et al. |
| 3,570,366 | A | 3/1971 | Nickel |
| 3,611,869 | A | 10/1971 | Hupp |
| 3,630,118 | A | 12/1971 | Stoner |
| 3,731,588 | A | 5/1973 | Curtis et al. |
| 3,744,371 | A | 7/1973 | McFarland |
| 3,766,825 | A | 10/1973 | Robinson |
| 3,768,190 | A | 10/1973 | Ruger et al. |
| 3,810,326 | A | 5/1974 | Hilberg et al. |
| 3,999,461 | A | 12/1976 | Johnson et al. |
| 4,004,489 | A | 1/1977 | Johnson et al. |
| 4,022,105 | A | 5/1977 | White |
| 4,061,074 | A | 12/1977 | Johnson et al. |
| 4,069,740 | A | 1/1978 | Hottinger et al. |
| 4,119,012 | A | 10/1978 | Frye |
| 4,223,589 | A | 9/1980 | Post |
| 4,395,937 | A | 8/1983 | Ottolini |
| 4,463,654 | A | 8/1984 | Barnes et al. |
| 4,562,659 | A | 1/1986 | Neta |
| 4,601,123 | A | 7/1986 | Swearengen et al. |
| 4,635,530 | A | 1/1987 | Weldle |
| 4,663,876 | A | 5/1987 | Reaume |
| 4,677,781 | A | 7/1987 | Lee |
| 4,709,617 | A | 12/1987 | Anderson |
| 4,856,410 | A | 8/1989 | Anderson |
| 4,867,039 | A | 9/1989 | Dobbins |
| 4,869,008 | A | 9/1989 | Rasmussen |
| 4,882,973 | A | 11/1989 | Piscetta |
| 4,932,148 | A | 6/1990 | Barrett |
| 4,944,109 | A | 7/1990 | Zedrosser |
| 5,119,575 | A | 6/1992 | Gajdica |
| 5,171,934 | A | 12/1992 | Moore |
| 5,235,769 | A | 8/1993 | Stead et al. |
| 5,361,700 | A | 11/1994 | Carbone |
| 5,367,810 | A | 11/1994 | Stead et al. |
| 5,675,110 | A | 12/1997 | Gyre et al. |
| 5,827,991 | A | 10/1998 | Predazzer |
| 5,834,678 | A | 11/1998 | Kalb |
| 6,135,005 | A | 10/2000 | Dobbins |
| 6,415,701 | B1 | 11/2002 | Dobbins |
| 6,481,144 | B1 | 11/2002 | Chee et al. |
| 6,779,461 | B1 | 8/2004 | Olson et al. |
| 6,860,207 | B1 | 3/2005 | Robertson |
| 6,877,265 | B2 | 4/2005 | Hajar et al. |
| 7,047,684 | B2 | 5/2006 | Roh |
| 7,066,092 | B2 | 6/2006 | Olson et al. |
| 7,069,863 | B2 | 7/2006 | Olson et al. |
| 7,165,352 | B2 | 1/2007 | Langlotz |
| 7,231,864 | B2 | 6/2007 | Ratti |
| 7,252,038 | B2 | 8/2007 | Olson et al. |
| 7,356,958 | B2 | 4/2008 | Weir |
| 7,380,361 | B2 | 6/2008 | Hajjar et al. |
| 7,448,307 | B1 | 11/2008 | Dafinov |
| 7,451,706 | B2 | 11/2008 | Meyer |
| 7,469,496 | B1 | 12/2008 | Kellgren |
| 7,493,718 | B2 | 2/2009 | Gorzen |
| 7,634,959 | B2 | 12/2009 | Frickey |
| 7,814,695 | B1 | 10/2010 | Keeney et al. |
| 7,921,779 | B1 | 4/2011 | Olson et al. |
| 7,966,762 | B2 | 6/2011 | Barrett |
| 8,122,635 | B2 | 2/2012 | Pullicar |
| 8,161,886 | B2 | 4/2012 | Meyer |
| 8,261,479 | B2 | 9/2012 | Barrett |
| 8,353,123 | B2 | 1/2013 | Pullicar et al. |
| 8,615,915 | B2 | 12/2013 | Hunter et al. |
| 8,683,725 | B2 | 4/2014 | Munson |
| 8,683,726 | B1 | 4/2014 | Genton |
| 8,733,007 | B2 * | 5/2014 | Hatfield ..... F41A 9/35 42/1.02 |
| 8,782,940 | B1 | 7/2014 | Morris |
| 8,806,788 | B1 | 8/2014 | Hu |
| 8,819,976 | B1 | 9/2014 | Kellgren |
| 8,826,577 | B1 | 9/2014 | Bentley |
| 8,839,709 | B1 | 9/2014 | Crye et al. |
| 8,869,672 | B2 | 10/2014 | Smith |
| 8,925,234 | B1 | 1/2015 | Barrett |
| 8,931,393 | B1 | 1/2015 | Vincent et al. |
| 8,944,041 | B2 | 2/2015 | Hu |
| 9,010,233 | B2 | 4/2015 | St. George |
| 9,015,979 | B2 | 4/2015 | Safewright, Jr. |
| 9,015,981 | B2 | 4/2015 | Zamlinsky |
| 9,021,935 | B1 | 5/2015 | Kellgren |
| 9,062,922 | B1 | 6/2015 | Burt et al. |
| 9,097,476 | B2 | 8/2015 | Mead et al. |
| 9,109,849 | B2 | 8/2015 | Young et al. |
| 9,109,856 | B1 | 8/2015 | Zamlinsky |
| 9,115,954 | B1 | 8/2015 | Corsi et al. |
| 9,188,399 | B1 | 11/2015 | Findlay et al. |
| 9,200,857 | B1 | 12/2015 | Kellgren |
| 9,341,429 | B1 | 1/2016 | Reavis, III |
| 9,347,725 | B2 | 5/2016 | McAlister |
| 9,347,737 | B2 | 5/2016 | Troy et al. |
| 9,534,861 | B1 | 1/2017 | Kellgren |
| 9,562,731 | B2 | 2/2017 | Geissele |
| 9,612,067 | B2 | 4/2017 | Boyarkin |
| 9,759,504 | B2 | 9/2017 | Geissele |
| 9,958,230 | B1 | 5/2018 | Nugent et al. |
| 10,006,727 | B2 | 6/2018 | Barrett et al. |
| 10,041,754 | B2 | 8/2018 | Tamir |
| 10,088,257 | B2 | 10/2018 | Popikov et al. |
| 10,145,631 | B2 | 12/2018 | Barrett et al. |
| 10,161,709 | B1 | 12/2018 | Wright |
| 10,288,369 | B2 | 5/2019 | Albury |
| 10,317,156 | B2 | 6/2019 | Shaver |
| 10,345,074 | B1 | 7/2019 | Zamlinskiy |
| 10,605,548 | B1 | 3/2020 | Lukofnak, III |
| 10,890,391 | B1 * | 1/2021 | Geissele ..... F41A 3/66 |
| 2005/0235546 | A1 | 10/2005 | Wonisch et al. |
| 2007/0033850 | A1 | 2/2007 | Murello et al. |
| 2007/0151438 | A1 | 7/2007 | Courty |
| 2008/0121096 | A1 | 5/2008 | Hajjar et al. |
| 2009/0211140 | A1 | 8/2009 | Rolfe |
| 2011/0209607 | A1 | 9/2011 | St. George |
| 2013/0185975 | A1 | 7/2013 | Johnson |
| 2014/0075803 | A1 | 3/2014 | Muller |
| 2014/0075812 | A1 | 3/2014 | Johnson |
| 2014/0259848 | A1 * | 9/2014 | Chvala ..... F41C 23/14 42/73 |
| 2015/0107143 | A1 | 4/2015 | Coetzee et al. |
| 2015/0316339 | A1 | 11/2015 | Young et al. |
| 2016/0153732 | A1 | 6/2016 | Geissele |
| 2018/0224233 | A1 | 8/2018 | Macy |
| 2019/0186854 | A1 | 6/2019 | Berrett et al. |
| 2019/0204034 | A1 | 7/2019 | Young et al. |
| 2021/0048262 | A1 * | 2/2021 | Muska ..... F41C 23/04 |

FOREIGN PATENT DOCUMENTS

| | | |
|---|---|---|
| DE | 102007034671 | 1/2009 |
| DE | 102007034675 | 1/2009 |
| FR | 2231936 | 12/1974 |
| FR | 2502321 | 9/1982 |
| GB | 573429 | 6/1941 |
| RU | 2055296 | 2/1996 |
| WO | 200114819 | 3/2001 |
| WO | 2005015113 | 2/2005 |
| WO | 2012005829 | 1/2012 |

* cited by examiner

SHOTGUN CONFIGURATION

CROSS REFERENCE TO RELATED APPLICATIONS

This application is based upon and claims benefit of priority to U.S. Provisional Application No. 62/883,160, filed Aug. 6, 2019, which application is hereby incorporated by reference herein.

FIELD OF THE INVENTION

This invention relates to firearms such as shotguns.

BACKGROUND

Shotguns for self-defense should be compact, easy to wield, have an ample ammunition capacity and function reliably. These characteristics are readily captured in the so-called "bullpup" configuration, wherein the firearm's action is behind the trigger group. The bullpup configuration permits a firearm having a short overall length without sacrificing barrel length. Multiple tubular magazines may be used to ensure sufficient ammunition capacity while maintaining a compact design. Ease of manufacture, maintenance and improved reliability may be realized by a design which uses sub-assemblies among which the various firearm mechanisms are distributed in a manner which favors ready assembly and disassembly of the firearm.

SUMMARY

The invention encompasses firearms comprising a plurality of sub-assemblies. In an example embodiment of a firearm according to the invention, the plurality of sub-assemblies comprises a lower receiver. An upper receiver is mounted on the lower receiver. A butt stock is mounted on the lower receiver. A cover is positioned between the butt stock and the lower receiver.

An example embodiment may further comprise a pair of tabs mounted on the upper receiver and a pair of notches mounted on the lower receiver. Each notch receives one of the tabs when the upper receiver is mounted on the lower receiver. A first lug is mounted on the upper receiver. The first lug defines a first hole therethrough. A second lug is mounted on the lower receiver. The second lug defines a second hole therethrough. The first and second lugs engage one another and receive a pin extending between the first and second holes to secure the upper and lower receivers to one another. In an example embodiment, the butt stock is movably mounted on the lower receiver.

An example firearm according to the invention may further comprise a guide rail extending from the lower receiver. A cavity is positioned in the butt stock. The cavity receives the guide rail and guides motion of the butt stock relatively to the lower receiver. The cover is mounted on the butt stock in an example and is movable therewith between a closed position, overlying a breech end of the barrel, and an open position, exposing a breech end of the barrel.

An example embodiment may further comprise an ammunition elevator mounted on the butt stock. By way of example, a barrel is mounted on the upper receiver. First and second magazines are also mounted on the upper receiver adjacent to the barrel in an example. The first and second magazines may comprise tube magazines. A fore-end is mounted on the upper receiver and is slidably movable along the barrel. A fire control mechanism may be positioned within the lower receiver in a further example embodiment.

An example firearm according to the invention may further comprise a first magazine cut-off mounted on the upper receiver. The first magazine cut-off may comprise a first blocking surface movable relatively to the first magazine for controlling release of ammunition therefrom. A second magazine cut-off may be mounted on the upper receiver. The second magazine cut-off may comprise a second blocking surface movable relatively to the second magazine for controlling release of ammunition therefrom. An example embodiment may further comprise a third magazine cut-off mounted on the upper receiver. In an example embodiment the third magazine cut-off comprises third and fourth blocking surfaces movable relatively to the first and second magazines for controlling release of ammunition therefrom. As an example, the first magazine cut-off is mounted on the first magazine, the second magazine cut-off is mounted on the second magazine, and the third magazine cut-off is mounted on the first and second magazines.

In an example embodiment the fore-end may comprise a chassis. A selector may be mounted on the chassis. The selector has a selector surface movable relatively to the chassis between a first position, wherein upon motion of the fore-end, the selector surface is engageable with the first magazine cut-off to release ammunition from the first magazine, and a second position wherein, upon motion of the fore-end, the selector surface is engageable with the second magazine cut-off to release ammunition from the second magazine. By way of example an interrupter may be mounted on the upper receiver. In an example embodiment the interrupter comprises an interrupter surface extending lengthwise along the upper receiver. A boss projects from the selector. The boss engages the interrupter surface and thereby prevents motion of the selector unless the fore-end is positioned in a foremost position relatively to the barrel. In an example embodiment the interrupter surface is mounted between the first and second magazines.

By way of example the fore-end may also comprise a chassis having an actuator mounted thereon. The actuator is engageable with the third magazine cut-off upon motion of the fore-end. An example embodiment of the firearm according to the invention comprises a shotgun.

The invention also encompasses a shotgun comprising a plurality of sub-assemblies. In an example embodiment the plurality of sub-assemblies comprises an upper receiver including a barrel. At least a first magazine is attached to the barrel and a fore-end is slidably movable along the barrel. A lower receiver includes a fire control mechanism. The upper receiver is mounted on the lower receiver. A butt stock is mounted on the lower receiver. A cover is positioned between the butt stock and the lower receiver. In an example embodiment the shotgun further comprises a pair of tabs mounted on the upper receiver. A pair of notches are mounted on the lower receiver. Each notch receives one of the tabs when the upper receiver is mounted on the lower receiver. A first lug is mounted on the upper receiver. The first lug defines a first hole therethrough. A second lug is mounted on the lower receiver. The second lug defines a second hole therethrough. The first and second lugs engage one another and receiving a pin extending between the first and second holes to secure the upper and lower receivers to one another. In an example embodiment the butt stock is movably mounted on the lower receiver. An example shotgun according to the invention may further comprise a guide rail extending from the lower receiver. A cavity is positioned in the butt stock. The cavity receives the guide rail and guids motion of the butt stock relatively to the lower receiver.

By way of example, the cover may be mounted on the butt stock and movable therewith between a closed position overlying a breech end of the barrel, and an open position exposing a breech end of the barrel. An ammunition elevator may be mounted on the butt stock in an example embodiment. By way of example, a second magazine may be mounted on the upper receiver. The first and second magazines may comprise tube magazines.

In an example embodiment a first magazine cut-off is mounted on the upper receiver. The first magazine cut-off comprises a first blocking surface movable relatively to the first magazine for controlling release of ammunition therefrom. A second magazine cut-off is mounted on the upper receiver. The second magazine cut-off comprises a second blocking surface movable relatively to the second magazine for controlling release of ammunition therefrom. Further by way of example, a third magazine cut-off is mounted on the upper receiver. The third magazine cut-off compriss third and fourth blocking surfaces movable relatively to the first and second magazines for controlling release of ammunition therefrom. Further by way of example, the first magazine cut-off is mounted on the first magazine, the second magazine cut-off is mounted on the second magazine, and the third magazine cut-off is mounted on the first and second magazines.

In an example shotgun according to the invention the fore-end comprises a chassis. A selector is mounted on the chassis. The selector has a selector surface movable relatively to the chassis between a first position, wherein upon motion of the fore-end, the selector surface is engageable the first magazine cut-off to release ammunition from the first magazine, and a second position, wherein upon motion of the fore-end, the selector surface is engageable with the second magazine cut-off to release ammunition from the second magazine. An example shotgun may further comprise an interrupter mounted on the upper receiver. An example interrupter comprises an interrupter surface extending lengthwise along the upper receiver. A boss projects from the selector. The boss engages the interrupter surface and thereby prevents motion of the selector unless the fore-end is positioned in a foremost position relatively to the barrel. By way of example the interrupter surface is mounted between the first and second magazines. In a further example, the fore-end comprises a chassis having an actuator mounted thereon. The actuator is engageable with the third magazine cut-off upon motion of the fore-end.

DETAILED DESCRIPTION

Figure 1:
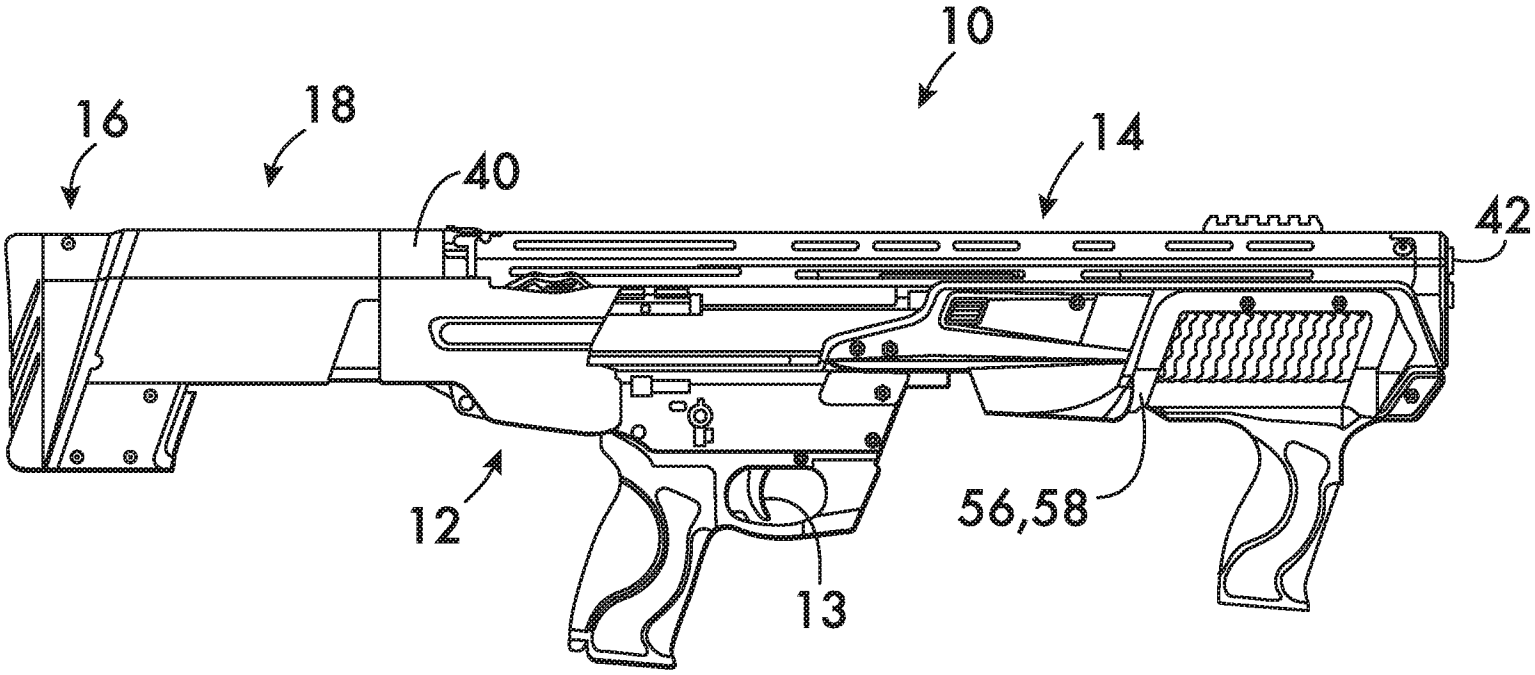
FIG. 1 is a side view of an example firearm according to the invention.
Figure 2:
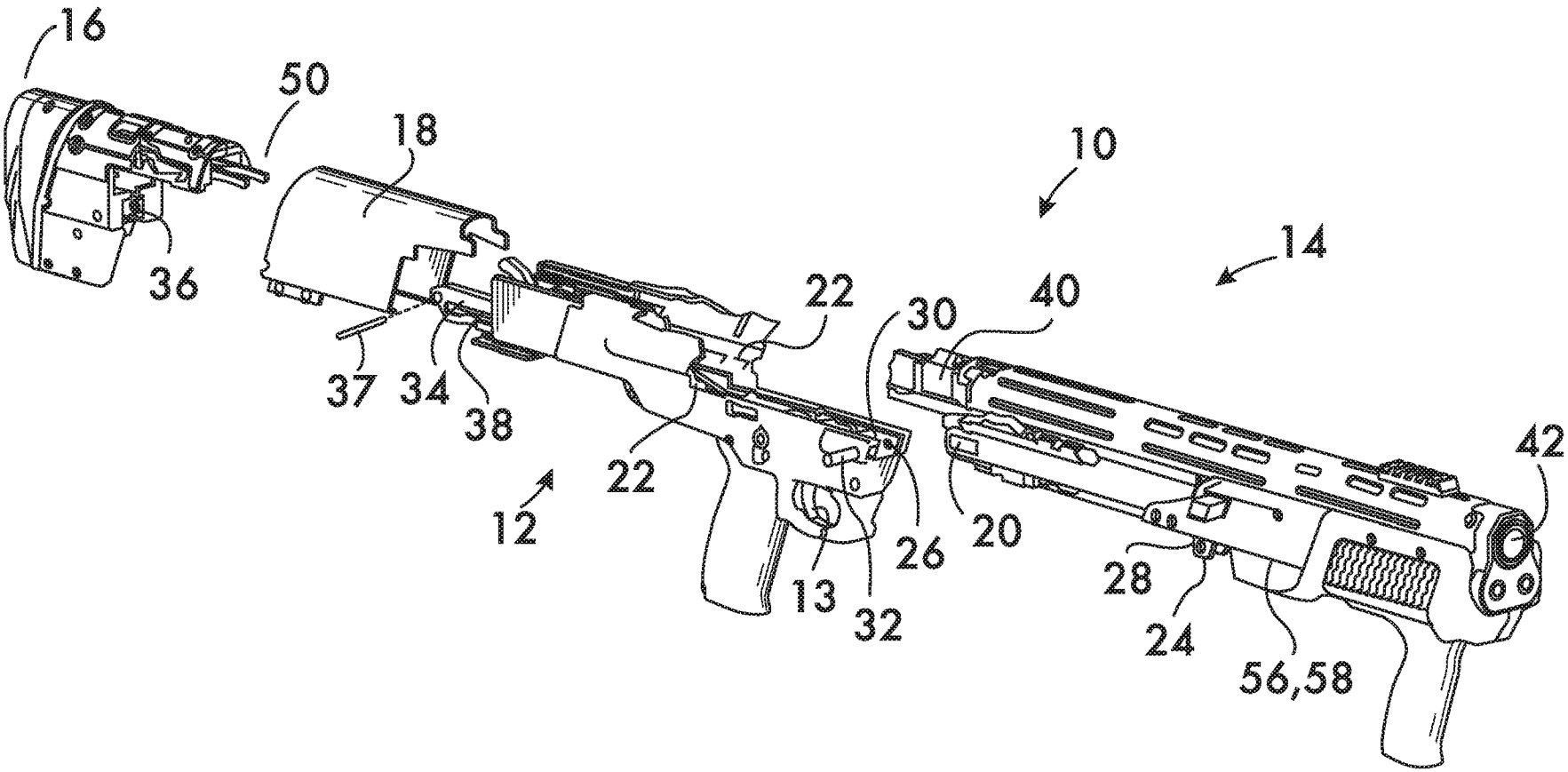
FIG. 2 is an exploded isometric view illustrating the sub-assemblies of the firearm shown in FIG. 1.

FIGS. 1 and 2 show a firearm, in this example a self-defense shotgun 10, according to the invention. Shotgun 10 comprises a plurality of sub-assemblies. In this example sub-assemblies include a lower receiver 12 which houses a fire control mechanism 13, an upper receiver 14 mounted on the lower receiver, a butt stock 16 also mounted on the lower receiver 12, and a cover 18 positioned between the butt stock 16 and the lower receiver 12. As shown in FIG. 2, the sub-assemblies are advantageously removably attached to one another to permit rapid takedown and reassembly for field stripping and repair. Removeable attachment of the upper receiver 14 to the lower receiver 12 is enabled by a pair of tabs 20 mounted on opposite sides of the upper receiver 14 (only one tab being shown). Tabs 20 project outwardly from the upper receiver 14 and are received within a pair of mating notches 22 positioned on the lower receiver 12. Each notch 22 receives a respective one of the tabs 20 when the upper receiver 14 is mounted on the lower receiver 12. The tabs 20 and their mating notches 22 cooperate to align and fix the upper and lower receivers with respect to one another. Engagement between the upper and lower receivers 14 and 12 is further secured via a first lug 24 mounted on the upper receiver 14, and a second lug 26 mounted on the lower receiver 12. The first lug 24 define a first hole 28 therethrough and the second lug 26 defining a second hole 30 therethrough. When tabs 20 properly engage notches 22 the first and second lugs 24 and 26 engage one another such that the first and second holes 28 and 30 align to receive a pin 32 which extends between the first and second holes to secure the upper and lower receivers 14 and 12 to one another. The pin 32 may be retained within the low or upper receiver using a spring biased detent (not shown) or it may be dimensioned to fit snugly within the holes while still being removable using a tool to permit takedown of the shotgun 10.

Figure 3:
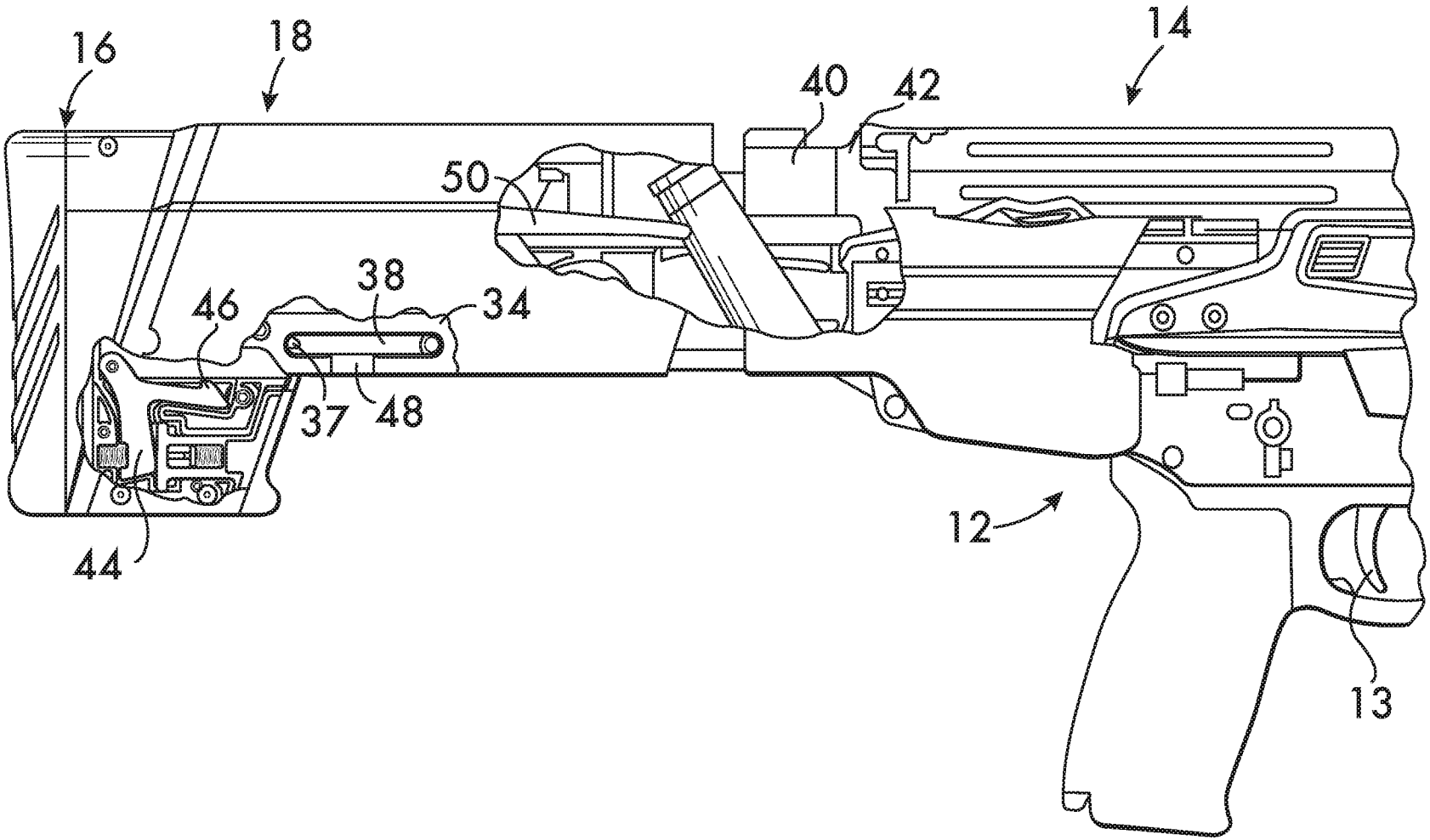
FIG. 3 is partial cut-away view of a portion of the firearm shown in FIG. 1.

As shown in FIGS. 2 and 3, the butt stock 16 is movably mounted on the lower receiver 12, and capable of sliding motion relative to the lower receiver in this example. The movable mounting comprises a guide rail 34 which extends from the lower receiver 12, the guide rail being received within a cavity 36 positioned in the butt stock 12. Engagement between the guide rail and cavity constrains motion of the butt stock 16 to sliding motion relatively to the lower receiver 12. In this example the butt stock 16 is retained to the lower receiver 12 via a guide pin 37 which engages a guide slot 38 within the guide rail 34. The cover 18, mounted on the butt stock 16, moves with the butt stock between a closed position (shown in FIG. 1) wherein the cover overlies the breech end 40 of the barrel 42 mounted on the upper receiver 14 (see FIG. 2), and an open position exposing the breech end 40 of the barrel 42 as shown in FIG. 3. Movable butt stock and cover sub-assemblies 16 and 18 advantageously allow access to the breech end 40 to permit an ammunition misfeed to be easily cleared. The butt stock 16 may be held with the cover 18 in the closed position by a latch mechanism 44 mounted in the butt stock 16, the latch mechanism having a movable hook 46 which engages an opening 48 in the guide rail 34. As further shown in FIGS. 2 and 3, an ammunition elevator 50 may be mounted on the butt stock 16. Positioning the elevator 50 on the butt stock 16 is advantageous when the shotgun has a bullpup configuration, as in this example.

Figure 4:
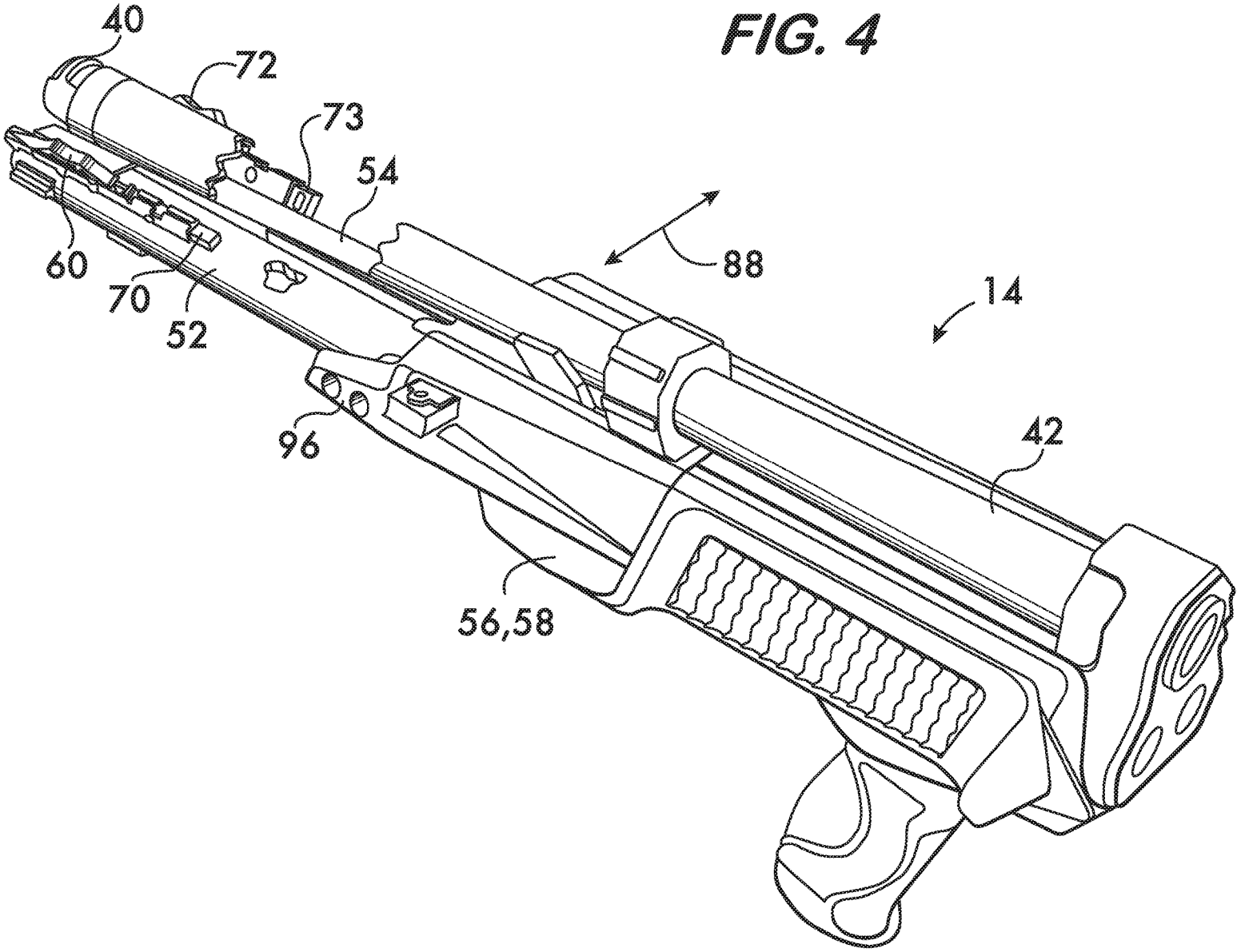
FIG. 4 is an isometric view of a portion of an example upper receiver sub-assembly according to the invention.

As shown in FIG. 4, the barrel 42 is mounted on the upper receiver 14. First and second magazines 52 and 54 are also mounted on the upper receiver 14 adjacent to the barrel 42. In this example embodiment the first and second magazines comprises tube magazines. A fore-end 56 is mounted on the upper receiver 14. Fore-end 56 is slidably movable along the barrel 42 to cycle the shotgun's action. In this example shotgun the fore-end 56 comprises a chassis 58 on which other mechanisms may be mounted as described below.

Figure 5:
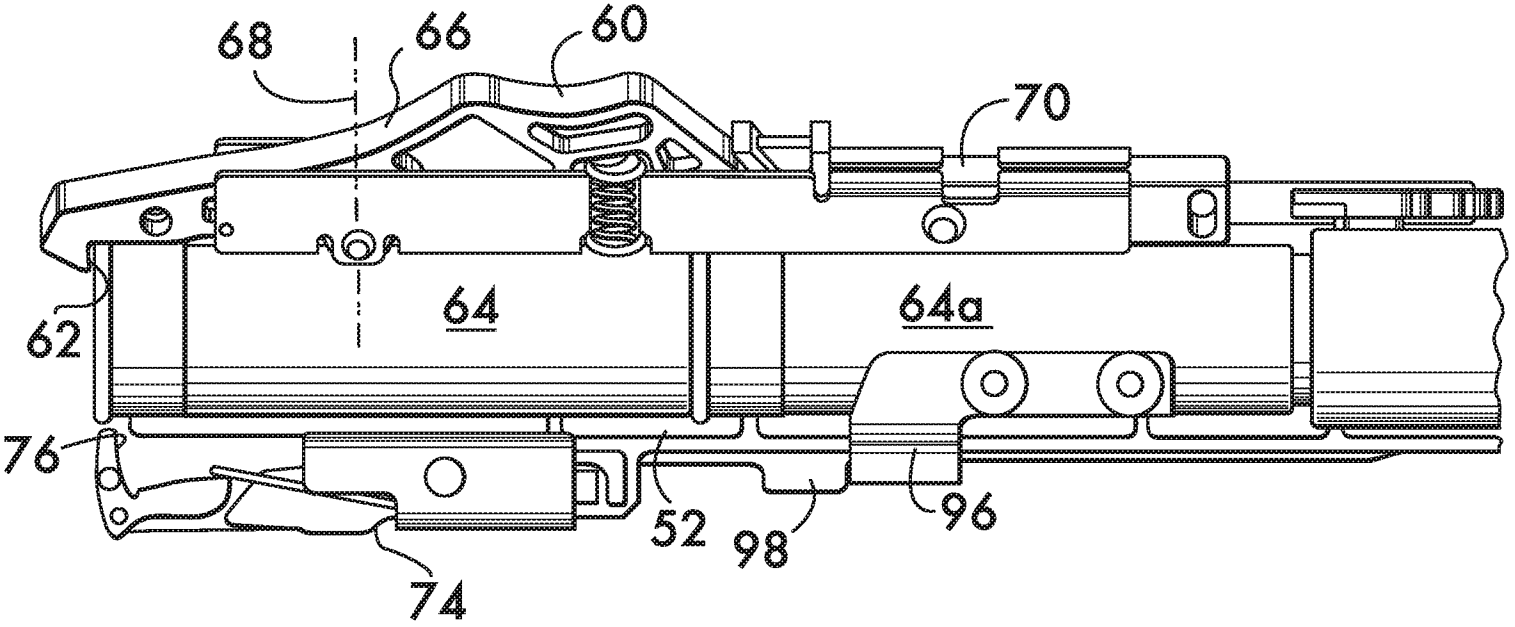
FIG. 5 is a side view of a portion of an example upper receiver according to the invention.

Release of ammunition from the first magazine 52 is controlled by a first magazine cut-off 60 mounted on the upper receiver 14. In this example the first magazine cut-off 60 is mounted on the first magazine 52 and, as shown in FIG. 5, comprises a first blocking surface 62 movable relatively to the first magazine 52 for controlling release of ammunition 64 therefrom. It is advantageous to mount the first blocking surface 62 at the end of a first lever 66 which pivots about a first axis 68 when engaged by a first cam 70 which is slidably mounted on the first magazine 52. Pivoting motion of the first lever 66 moves the first blocking surface 62 between a position blocking the first magazine 52 (shown) and a second position not blocking the magazine to release the ammunition 64. As shown in FIG. 4, a second magazine cut-off 72, identical to the first magazine cut-off 60, is also mounted on the upper receiver 14, in this example, on the second magazine 54. The second magazine cut-off 72 also comprises a second blocking surface (not shown) movable relatively to the second magazine 54 for controlling release of ammunition therefrom.

Figure 6:
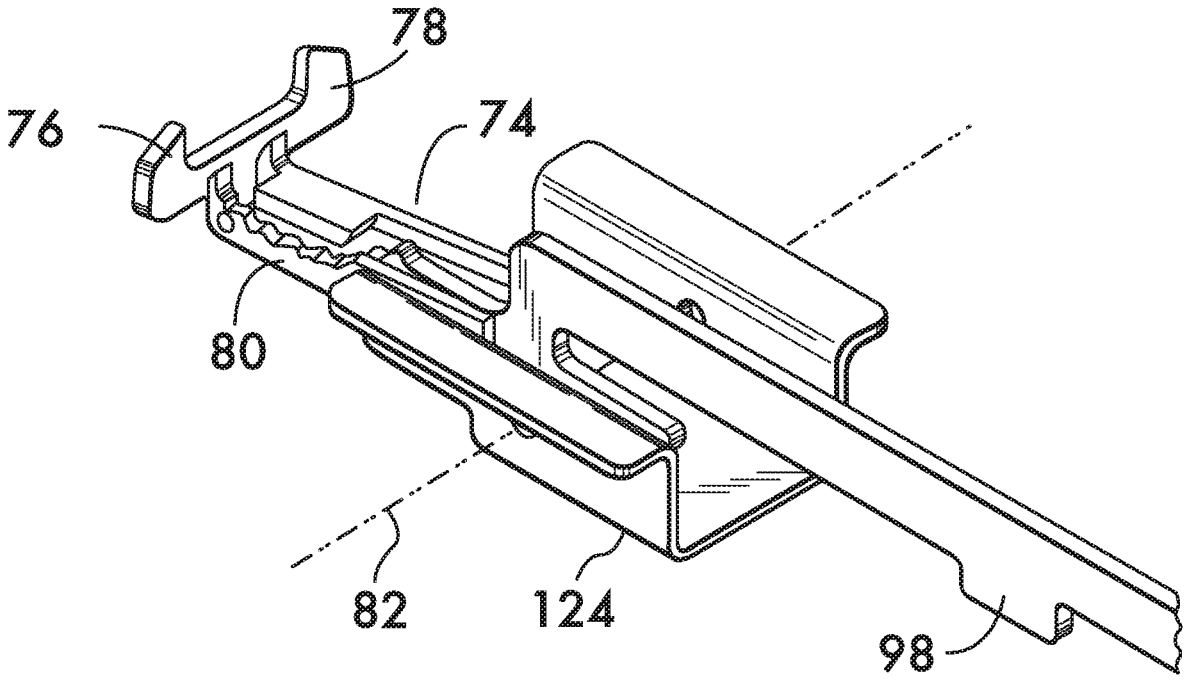
FIG. 6 is an isometric view of an example cut-off mechanism used in a sub-assembly according to the invention.

FIGS. 5 and 6 show a third magazine cut-off 74 mounted on the upper receiver 14. In this example the third magazine cut-off 74 is mounted on both the first and second magazines 52 and 54 and, as shown in FIG. 6, comprises third and fourth blocking surfaces 76 and 78 movable relatively to the first and second magazines for controlling release of ammunition therefrom. It is advantageous to position the third and fourth blocking surfaces 76 and 78 at the end of a lever 80 pivotable about an axis 82 to move the blocking surfaces 76 and 78 between a position not blocking the first and second magazines 52 and 54 (FIG. 5) to permit release of ammunition 64 from a magazine, and a position blocking the magazine to prevent a subsequent round of ammunition 64*a* from leaving the magazine after round 64 has been released.

Figure 8:
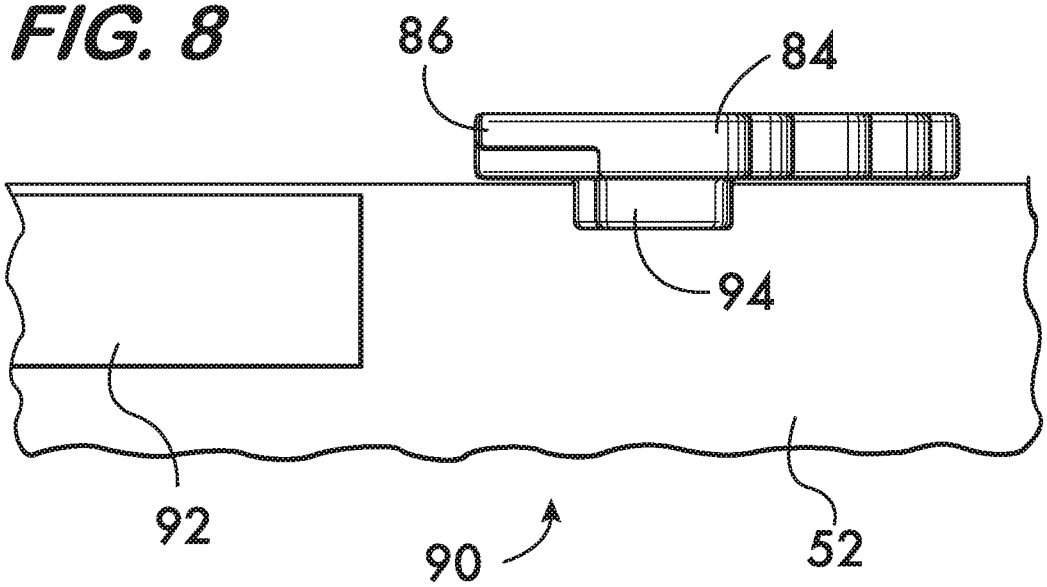
FIG. 8 is a side view of the example selector and interrupter shown in FIG. 7.
Figure 7:
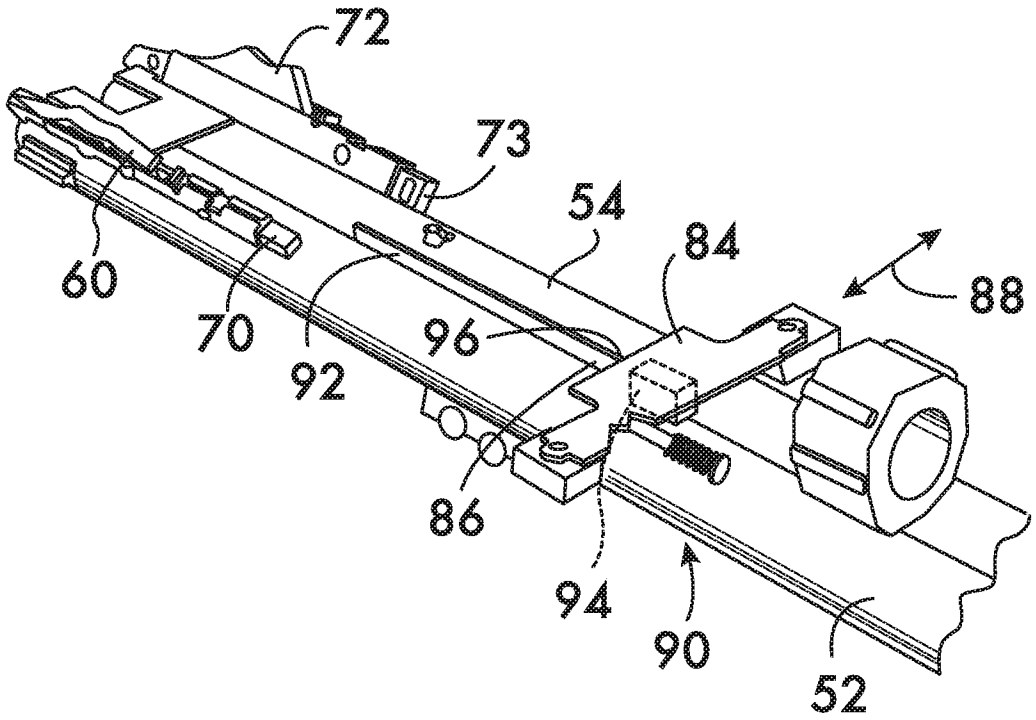
FIG. 7 is an isometric view of a portion of an upper receiver showing an example selector and interrupter according to the invention.

FIGS. 7 and 8 illustrate a selector 84 mounted on the chassis 58. Selector 84 has a selector surface 86 movable relatively to the chassis 58 (see FIG. 4) in a direction 88 transverse to the magazines 52 and 54 between a first position (shown) wherein upon motion of the fore-end 56, the selector surface 86 is engageable with the first cam 70 to actuate the first magazine cut-off 60 to release ammunition from the first magazine 52, and a second position, wherein upon motion of the fore-end 56, the selector surface 86 is engageable with a second cam 73 to actuate the second magazine cut-off 72 and release ammunition from the second magazine 54.

To prevent a malfunction known as "action lock-up" due to a second round of ammunition being released from a magazine while a first round is being chambered, an interrupter 90 is mounted on the upper receiver 14. As shown in FIGS. 7 and 8, the interrupter 90 comprises an interrupter surface 92 extending lengthwise along the upper receiver 14, in this example, mounted between the first and second magazines 52 and 54. A boss 94 which projects from the selector 86 engages the interrupter surface 92 and to prevent transverse motion of the selector 86, and consequently the selector surface 86, unless the fore-end 56 is positioned in a foremost position relatively to the barrel 42. This permits magazine selection only when the action of shotgun 10 is fully in battery and thus avoids lock-up malfunction.

As shown in FIGS. 4 and 5, an actuator 96 is also mounted on the chassis 58. Actuator 96 is engageable with the third magazine cut-off 74 via a third cut-off cam 98 (see also FIG. 6) upon motion of the fore-end 56 and cooperates with the selector 84 to control release of ammunition from the magazines.

Self-defense shotguns comprising sub-assemblies according to the invention are expected to be easier to manufacture, field strip and clean and thereby provide more reliable operation.

What is claimed is:

1. A firearm comprising a plurality of sub-assemblies, said plurality of sub-assemblies comprising:
- a lower receiver;
- an upper receiver mounted on said lower receiver;
- a butt stock mounted on said lower receiver;
- an ammunition elevator mounted on said butt stock;
- a cover positioned between said butt stock and said lower receiver.

2. The firearm according to claim 1, further comprising:
- a pair of tabs mounted on said upper receiver;
- a pair of notches mounted on said lower receiver, each said notch receiving one of said tabs when said upper receiver is mounted on said lower receiver;
- a first lug mounted on said upper receiver, said first lug defining a first hole therethrough;
- a second lug mounted on said lower receiver, said second lug defining a second hole therethrough, said first and second lugs engaging one another and receiving a pin extending between said first and second holes to secure said upper and lower receivers to one another.

3. The firearm according to claim 1, wherein said butt stock is movably mounted on said lower receiver.

4. The firearm according to claim 3, further comprising:
- a guide rail extending from said lower receiver;
- a cavity positioned in said butt stock, said cavity receiving said guide rail and guiding motion of said butt stock relatively to said lower receiver.

5. The firearm according to claim 4, wherein said cover is mounted on said butt stock and movable therewith between a closed position overlying a breech end of said barrel, and an open position exposing a breech end of said barrel.

6. The firearm according to claim 1, further comprising:
- a barrel mounted on said upper receiver;
- first and second magazines mounted on said upper receiver adjacent to said barrel, said first and second magazines comprising tube magazines;
- a fore-end mounted on said upper receiver and slidably movable along said barrel;
- a fire control mechanism positioned within said lower receiver.

7. The firearm according to claim 6, further comprising:
- a first magazine cut-off mounted on said upper receiver, said first magazine cut-off comprising a first blocking surface movable relatively to said first magazine for controlling release of ammunition therefrom;
- a second magazine cut-off mounted on said upper receiver, said second magazine cut-off comprising a second blocking surface movable relatively to said second magazine for controlling release of ammunition therefrom.

8. The firearm according to claim 7, further comprising a third magazine cut-off mounted on said upper receiver, said third magazine cut-off comprising third and fourth blocking surfaces movable relatively to said first and second magazines for controlling release of ammunition therefrom.

9. The firearm according to claim 8, wherein said first magazine cut-off is mounted on said first magazine, said second magazine cut-off is mounted on said second magazine, and said third magazine cut-off is mounted on said first and second magazines.

10. The firearm according to claim 7, wherein, said fore-end comprises a chassis, a selector being mounted on said chassis, said selector having a selector surface movable relatively to said chassis between a first position, wherein upon motion of said fore-end, said selector surface is engageable with said first magazine cut-off to release ammunition from said first magazine, and a second position wherein, upon motion of said fore-end, said selector surface is engageable with said second magazine cut-off to release ammunition from said second magazine.

11. The firearm according to claim 10, further comprising an interrupter mounted on said upper receiver, said interrupter comprising:

an interrupter surface extending lengthwise along said upper receiver;

a boss projecting from said selector, said boss engaging said interrupter surface and thereby preventing motion of said selector unless said fore-end is positioned in a foremost position relatively to said barrel.

12. The firearm according to claim 11, wherein said interrupter surface is mounted between said first and second magazines.

13. The firearm according to claim 8, wherein said fore-end comprises a chassis having an actuator mounted thereon, said actuator being engageable with said third magazine cut-off upon motion of said fore-end.

14. The firearm according to claim 6, wherein said firearm comprises a shotgun.

15. A shotgun comprising a plurality of sub-assemblies, said plurality of sub-assemblies comprising:

an upper receiver including a barrel, at least a first magazine attached to said barrel and a fore-end slidably movable along said barrel;

a lower receiver including a fire control mechanism, said upper receiver being mounted on said lower receiver;

a butt stock mounted on said lower receiver;

an ammunition elevator mounted on said butt stock;

a cover positioned between said butt stock and said lower receiver.

16. The shotgun according to claim 15, further comprising:

a pair of tabs mounted on said upper receiver;

a pair of notches mounted on said lower receiver, each said notch receiving one of said tabs when said upper receiver is mounted on said lower receiver;

a first lug mounted on said upper receiver, said first lug defining a first hole therethrough;

a second lug mounted on said lower receiver, said second lug defining a second hole therethrough, said first and second lugs engaging one another and receiving a pin extending between said first and second holes to secure said upper and lower receivers to one another.

17. The shotgun according to claim 15, wherein said butt stock is movably mounted on said lower receiver.

18. The shotgun according to claim 17, further comprising:

a guide rail extending from said lower receiver;

a cavity positioned in said butt stock, said cavity receiving said guide rail and guiding motion of said butt stock relatively to said lower receiver.

19. The shotgun according to claim 18, wherein said cover is mounted on said butt stock and movable therewith between a closed position overlying a breech end of said barrel, and an open position exposing a breech end of said barrel.

20. The shotgun according to claim 15, further comprising a second magazine mounted on said upper receiver, said first and second magazines comprising tube magazines.

21. The shotgun according to claim 18, further comprising:

a first magazine cut-off mounted on said upper receiver, said first magazine cut-off comprising a first blocking surface movable relatively to said first magazine for controlling release of ammunition therefrom;

a second magazine cut-off mounted on said upper receiver, said second magazine cut-off comprising a second blocking surface movable relatively to said second magazine for controlling release of ammunition therefrom.

22. The shotgun according to claim 21, further comprising a third magazine cut-off mounted on said upper receiver, said third magazine cut-off comprising third and fourth blocking surfaces movable relatively to said first and second magazines for controlling release of ammunition therefrom.

23. The shotgun according to claim 22, wherein said first magazine cut-off is mounted on said first magazine, said second magazine cut-off is mounted on said second magazine, and said third magazine cut-off is mounted on said first and second magazines.

24. The shotgun according to claim 21, wherein, said fore-end comprises a chassis, a selector being mounted on said chassis, said selector having a selector surface movable relatively to said chassis between a first position, wherein upon motion of said fore-end, said selector surface is engageable said first magazine cut-off to release ammunition from said first magazine, and a second position wherein, upon motion of said fore-end, said selector surface is engageable with said second magazine cut-off to release ammunition from said second magazine.

25. The shotgun according to claim 24, further comprising an interrupter mounted on said upper receiver, said interrupter comprising:

an interrupter surface extending lengthwise along said upper receiver;

a boss projecting from said selector, said boss engaging said interrupter surface and thereby preventing motion of said selector unless said fore-end is positioned in a foremost position relatively to said barrel.

26. The shotgun according to claim 25, wherein said interrupter surface is mounted between said first and second magazines.

27. The shotgun according to claim 22, wherein said fore-end comprises a chassis having an actuator mounted thereon, said actuator being engageable with said third magazine cut-off upon motion of said fore-end.

* * * * *